US008770088B2

(12) United States Patent
Taguchi et al.

(10) Patent No.: US 8,770,088 B2
(45) Date of Patent: Jul. 8, 2014

(54) RECIPROCATING COMPRESSOR

(75) Inventors: Yukihiko Taguchi, Gunma (JP); Hiroshi Ikeda, Gunma (JP)

(73) Assignee: Sanden Corporation, Gunma (JP)

( * ) Notice: Subject to any disclaimer, the term of this patent is extended or adjusted under 35 U.S.C. 154(b) by 209 days.

(21) Appl. No.: 13/388,045

(22) PCT Filed: Jul. 29, 2010

(86) PCT No.: PCT/JP2010/062758

§ 371 (c)(1),
(2), (4) Date: Jan. 30, 2012

(87) PCT Pub. No.: WO2011/013734

PCT Pub. Date: Feb. 3, 2011

(65) Prior Publication Data

US 2012/0128509 A1 May 24, 2012

(30) Foreign Application Priority Data

Jul. 30, 2009 (JP) ..... 2009-177470

(51) Int. Cl.
*F04B 1/29* (2006.01)

(52) U.S. Cl.
USPC ..... 91/505; 417/222.2

(58) Field of Classification Search
USPC ..... 91/473, 482, 483, 504, 505, 506; 417/270, 271, 222.2, 222.1
See application file for complete search history.

(56) References Cited

U.S. PATENT DOCUMENTS 5,873,704 A * 2/1999 Ota et al. ..... 417/222.2
6,352,416 B1 * 3/2002 Ota et al. ..... 417/222.2

FOREIGN PATENT DOCUMENTS

| | | |
|---|---|---|
| JP | 10-205446 | 8/1998 |
| JP | 11-280646 | 10/1999 |
| JP | 2000-265948 | 9/2000 |
| JP | 2006-214396 | 8/2006 |
| JP | 2008-128091 | 6/2008 |
| WO | WO 2007/049430 | 5/2007 |

* cited by examiner

*Primary Examiner* — Bryan Lettman
(74) *Attorney, Agent, or Firm* — Cozen O'Connor

(57) ABSTRACT

A reciprocating compressor having an aperture control valve for an inlet passage. Sectional area of the inlet passage is maintained near the outlet holes of the aperture control valve, distribution of flow rates of refrigerant gas drawn into the cylinder bores during inlet stroke is even. A cylinder block is provided with cylinder bores, a valve plate opposing one end of the cylinder block having inlet and outlet hole pairs, and a cylinder head forming an annular outlet chamber and a cylindrical inlet chamber radially inside the outlet chamber. The cylinder head has an inlet passage and an outlet passage, and an aperture control valve with an inlet hole connecting with the inlet passage and outlet holes controlling the aperture of the inlet passage. The aperture control valve is disposed in the inlet chamber.

12 Claims, 6 Drawing Sheets

RECIPROCATING COMPRESSOR

RELATED APPLICATIONS

This is a U.S. national stage of application No. PCT/JP2010/06758, filed on Jul. 29, 2010.

This application claims the priority of Japanese application no. 2009-177470 filed Jul. 30, 2009, the entire content of which is hereby incorporated by reference.

TECHNICAL FIELD

The present invention relates to a reciprocating compressor comprising an aperture control valve for an inlet passage.

BACKGROUND ART

Patent Document 1 teaches a reciprocating compressor comprising an aperture control valve for an inlet passage.

In the reciprocating compressor of Patent Document 1, the aperture control valve decreases the aperture of the inlet passage when flow rate of refrigerant gas circulating in an air conditioner provided with the compressor to effectively prevent inlet pressure pulsation caused by self-excited vibration of the inlet valves of the compressor from propagating to an evaporator and also self-excited vibration of a valve body of the aperture control valve.

PRIOR ART DOCUMENT

Patent Document

Patent Document 1: Japanese Patent Laid-Open Publication No. 2006-214396

DISCLOSURE OF INVENTION

Problem to be solved

Drawbacks of the aforementioned compressor are as follows.

(1) The aperture control valve 30 is inserted into and installed in the inlet chamber 21 from outside the compressor through an inlet port 24. Therefore, installation of the aperture control valve 30 is not easy.

(2) The aperture control valve 30 is connected to the circumferential sidewall of the inlet chamber. Therefore, some among a plurality of outlet holes 32*a* closely oppose the end wall of the inlet chamber to cause insufficiency of sectional area of the inlet passage near the outlet holes 32*a* and increase of pressure loss at the time of large flow rate of refrigerant gas, thereby decreasing compression capability and durability.

(3) The inlet chamber 21 forms an annular passage. Therefore, distances between the aperture control valve and cylinder bores 16*a* differ from each other, flaw rates of refrigerant gas sucked into the cylinder bores 16*a* during inlet stroke differ from each other, and operation of the compressor becomes unstable.

(4) In the inlet chamber 21 forming an annular passage, the space extending from the aperture control valve to the cylinder bores does not form a muffler. Therefore, the structure of the aperture control valve cannot be optimized from the viewpoint of decreasing inlet pressure pulsation.

An object of the present invention is to provide a reciprocating compressor comprising an aperture control valve for an inlet passage, wherein installation of the aperture control valve is easy, sufficient sectional area of the inlet passage is maintained near the outlet holes of the aperture control valve, distribution of flaw rates of refrigerant gas sucked into the cylinder bores during inlet stroke is even, and the inlet chamber operates as a muffler to make it possible to optimize the structure of the aperture control valve from the viewpoint of decreasing inlet pressure pulsation.

Means for Solving the Problem

In accordance with the present invention, there is provided a reciprocating compressor comprising a cylinder block provided with a plurality of cylinder bores, a valve plate opposing one end of the cylinder block at one end face and provided with a plurality of inlet hole and outlet hole pairs each opposing one of the cylinder bores, and a cylinder head opposing the other end face of the valve plate and forming at the other end face side of the valve plate an annular outlet chamber and a cylindrical inlet chamber disposed radially inside the outlet chamber, wherein the cylinder head is provided with an inlet passage extending from the inlet chamber to connect with an external refrigerating circuit and an outlet passage extending from the outlet chamber to connect with the external refrigerating circuit, and further comprising an aperture control valve provided with an inlet hole connecting with the inlet passage and outlet holes communicating with the inlet chamber and controlling the aperture of the inlet passage in proportion to the pressure difference between the internal pressure of the inlet passage and the internal pressure of the inlet chamber, wherein the aperture control valve is disposed in the inlet chamber, and the aperture control valve engages the end wall of the inlet chamber opposing the valve plate at one end provided with the inlet hole and projects from the end wall of the inlet chamber toward the other end and the valve plate.

In the reciprocating compressor of the present invention, the inlet chamber can form a large space of great diameter because the inlet chamber is given a cylindrical form and disposed radially inside the annular outlet chamber. The aperture control valve can be engaged with the large-area end wall of the inlet chamber from the inlet chamber side before the cylinder head is assembled with the valve plate and the cylinder block so as to make the installation of the aperture control valve easy.

The aperture control valve is connected to the end wall of the inlet chamber of cylindrical form so as to reduce the variance of distances between the aperture control valve and the cylinder bores and the variance of flow rates of refrigerant gas sucked into the cylinder bores during inlet stroke, thereby stabilizing the operation of the reciprocating compressor.

In accordance with a preferred embodiment of the present invention, the outlet holes of the aperture control valve oppose the circumferential sidewall of the inlet chamber.

The aperture control valve is connected to the expansive end wall of the inlet chamber. Therefore, sufficient distance can be established between the outlet holes of the aperture control valve and the circumferential sidewall of the inlet chamber opposing the outlet holes so as to secure sufficient sectional area of the inlet passage near the outlet holes of the aperture control valve.

In accordance with another preferred embodiment of the present invention, the outlet holes of the aperture control valve are formed in the circumferential sidewall of a cylindrical body engaging the end wall of the inlet chamber at one end and projecting toward the other end and the valve plate, and wherein the outlet holes are located at a predetermined distance from the end wall of the inlet chamber at the portions of the peripheries close to the one end of the cylindrical body engaging the end wall of the inlet chamber.

As aforementioned, the inlet chamber can form a large space of great diameter so as to operate as a muffler. When an air passage is connected to a muffler, it is possible to control the length of the portion of the air passage projecting into the muffler so as to control the noise frequency to be decreased. In the aperture control valve of the compressor in accordance with the present preferred embodiment, the distance between the portions of the peripheries of the outlet holes close to the one end of the cylindrical body engaging the end wall of the inlet chamber and the end wall of the inlet chamber corresponds to the aforementioned length of the portion of the air passage projecting into the muffler. Therefore, it is possible to control the distance and make the noise frequency to be decreased resonant with the frequency of inlet pressure pulsation, thereby optimizing the structure of the aperture control valve from the viewpoint of decreasing inlet pressure pulsation.

In accordance with another preferred embodiment of the present invention, the aperture control valve fits in a concave formed in the end wall of the inlet chamber at one end provided with the inlet hole and abuts an anti-slip-off member at the other end to be prevented from axial movement.

When the aperture control valve fits in a concave formed in the end wall of the inlet chamber at one end, the installation of the aperture control valve in the compressor becomes easy. When the aperture control vale abuts an anti-slip-off member at the other end, the aperture control valve is prevented from slipping off the concave.

In accordance with another preferred embodiment of the present invention, the anti-slip-off member is selected from the group consisting of the valve plate, an outlet-valve-forming member provided with outlet valves, a head gasket disposed between the outlet-valve-forming member and the cylinder head, an inlet-valve-forming member provided with inlet valves, and a cylinder gasket disposed between the inlet-valve-forming member and the cylinder block.

When some existing element of the compressor is used as the anti-slip-off member, increase of the number of elements can be prevented.

In accordance with another preferred embodiment of the present invention, the anti-slip-off member and also a partition wall defining the inlet chamber is selected from the group consisting of an outlet-valve-forming member provided with outlet valves, a head gasket disposed between the outlet-valve-forming member and the cylinder head, an inlet-valve-forming member provided with inlet valves, and a cylinder gasket disposed between the inlet-valve-forming member and the cylinder block, and wherein a concave is formed in the one end of the cylinder block and the anti-slip-off member projects into the concave of the cylinder block.

When the aperture control valve projects into the concave of the cylinder block at the other end, the aperture control valve can be installed in the inlet chamber even if the height of the inlet chamber cannot be made large enough.

In accordance with another preferred embodiment of the present invention, the anti-slip-off member forms a biasing member for forcing the other end of the aperture control valve toward the one end.

When the biasing member operates as the anti-slip-off member, the aperture control valve can be reliably held by the compressor.

In accordance with another preferred embodiment of the present invention, the biasing member is a resilient member formed by one part of the outlet-valve-forming member cut out and raised up from the remaining part.

When one part of the outlet-valve-forming member is used as the biasing member, increase of the number of elements can be prevented.

In accordance with another preferred embodiment of the present invention, the aperture control valve comprises a first housing of cylindrical form provided with the inlet hole and a valve seat, a valve body detachably abuts the valve seat to open and close the inlet hole, a biasing member for forcing the valve body toward the valve seat, and a second housing of cylindrical form closed at one end provided with a plurality of outlet holes in the circumferential sidewall and a small hole in the bottom wall and accommodating the valve body and the biasing member and fitting on and fixed to the first housing, wherein the space formed by the bottom wall of the second housing, the valve body, and the circumferential sidewall of the second housing communicates with the inlet chamber through the small hole formed in the bottom wall of the second housing when the other end of the aperture control valve abuts the anti-slip-off member.

In accordance with the aforementioned structure, the internal pressure of the inlet chamber reliably acts in the space formed by the bottom wall of the second housing, the valve body, and the circumferential sidewall of the second housing. Therefore, the valve body can move reliably in proportion to the pressure difference between the internal pressure of the inlet passage upstream of the valve body and the internal pressure of the inlet chamber downstream of the valve body.

In accordance with another preferred embodiment of the present invention, the compressor further comprises projections provided on the bottom wall of the second housing or the anti-slip-off member, wherein the projections form a space between the small hole formed in the bottom wall of the second housing and the anti-slip-off member when the other end of the aperture control valve abuts the anti-slip-off member.

When a space is established between the small hole formed in the bottom wall of the second housing and the anti-slip-off member, the internal pressure of the inlet chamber can reliably act in the space formed by the bottom wall of the second housing, the valve body, and the circumferential sidewall of the second housing.

In accordance with another preferred embodiment of the present invention, the compressor further comprises an O-ring fitting on the outer circumferential surface of the one end of the aperture control valve, wherein the O-ring is forced to abut the circumferential wall of the concave formed in the end wall of the inlet chamber to make the cylinder head hold the aperture control valve.

An O-ring can be used for making the cylinder head hold the aperture control valve.

In accordance with another preferred embodiment of the present invention, the aperture control valve comprises a first housing provided with the inlet hole and a valve seat, a valve body detachably abuts the valve seat to open and close the inlet hole, a biasing member for forcing the valve body toward the valve seat, and a second housing of cylindrical form closed at one end provided with a plurality of outlet holes in the circumferential sidewall and a small hole in the bottom wall and accommodating the valve body and the biasing member and fitting on and fixed to the first housing, wherein the end wall of the inlet chamber opposing the valve plate forms the first housing.

When one part of the cylinder head forms the first housing, the number of elements decreases and production cost decreases.

In accordance with another preferred embodiment of the present invention, the central axis of the aperture control valve extends parallel to the central axes of the cylinder bores and is located inside a circle inscribed in the cylinder bores.

In accordance with the aforementioned structure, the aperture control valve is disposed at the center of the inlet chamber and directed in parallel with the cylinder bores. Therefore, variance of the distances between the aperture control valve and the cylinder bores decreases and variance of the flow rates of the refrigerant gas sucked into the cylinder bores during inlet stroke decreases.

MODES FOR CARRYING OUT THE INVENTION

Preferred embodiments of the present invention will be described.

Preferred Embodiment 1

Figure 1:
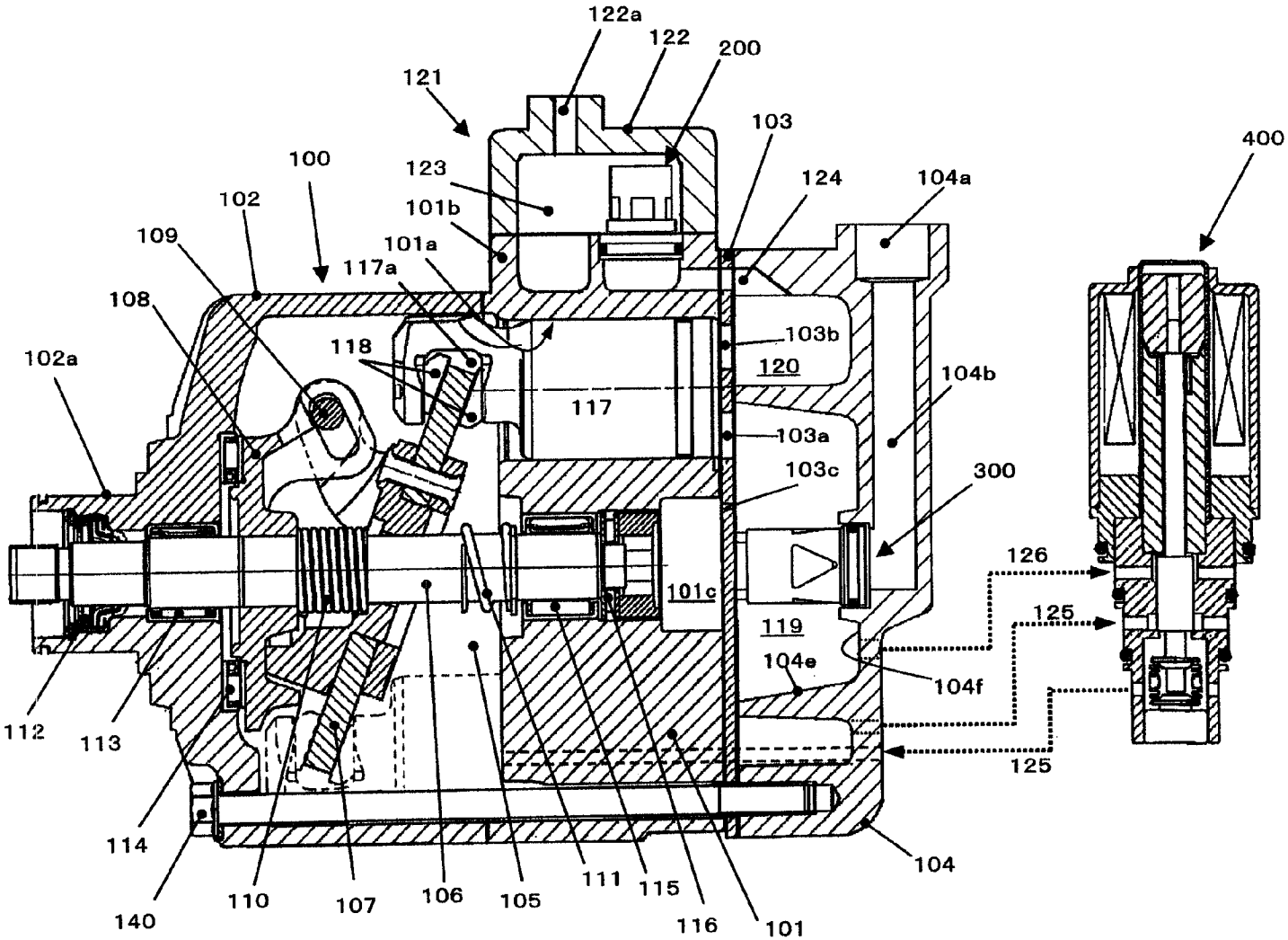
FIG. 1 is a sectional view of a variable displacement swash plate compressor in accordance with a first preferred embodiment of the present invention.

As shown in FIG. 1, a variable displacement swash plate compressor 100 is provided with a cylinder block 101 having a plurality of cylinder bores 101*a*. The cylinder bores 101*a* are disposed on a circle coaxial with the central axis of a driving shaft 106 which will be described later and uniformly spaced from each other. The compressor 100 is further provided with a front housing 102 of long cylindrical form closed at on end. The front housing 102 is disposed at one end of the cylinder block 101. The compressor 100 is further provided with a valve plate 103 opposing the other end of the cylinder block 101, and a cylinder head 104 of short cylindrical form closed at one end. The cylinder head 104 cooperates with the other end of the cylinder block 101 to clamp the valve plate 103.

The driving shaft 106 extends across a crank chamber 105 defined by the cylinder block 101 and the front housing 102. A swash plate 107 fits on the driving shaft 106. The swash plate 107 is connected to a rotor 108 fixed to the driving shaft 106 through a connection member 109 to be variable in inclination relative to the driving shaft 106. A coil spring 110 is disposed between the rotor 108 and the swash plate 107 to force the swash plate 107 in the direction of minimum inclination angle. A coil spring 111 is also provided. The coil springs 110 and 111 are disposed to face opposite surfaces of the swash plate 107. The coil spring 111 forces the swash plate 107 in the direction to increase the inclination angle of the swash plate 107.

One end of the driving shaft 106 passes through a boss 102*a* of the front housing 102 to extend out of the front housing 102, thereby being connected to a power transmission not shown in FIG. 1. A seal member 112 is disposed between the driving shaft 106 and the boss 102*a* to shut the crank chamber 105 off from the environment. The driving shaft 106 is supported in the radial direction and the thrust direction by bearings 113, 114,115 and 116. The driving shaft 106 is driven to rotate by power transmitted from an external power source through the power transmission.

Pistons 117 are inserted into the cylinder bores 101*a*. Each piston 117 is provided with a concave 117*a* at one end. The concave 117*a* accommodates a pair of shoes 118 for clamping the outer periphery of the swash plate 107 so as to be slidable relative to the outer periphery of the swash plate 107. Thus, the pistons 117 and the swash plate 107 are interlocked. Therefore, rotation of the driving shaft 106 is converted to reciprocal movement of the pistons 117 in the cylinder bores 101*a*.

The cylinder head 104 cooperates with the valve plate 103 to define as inlet chamber 119 and an outlet chamber 120. The inlet chamber 119 communicates with the cylinder bores 101*a* through communication holes 103*a* formed in the valve plate 103 and inlet valves not shown in FIG. 1. The outlet chamber 120 communicates with the cylinder bores 101*a* through outlet valves not shown in FIG. 1 and communication holes 103*b* formed in the valve plate 103.

The outlet chamber 120 has an annular form and the inlet chamber 119 is disposed radially inside the outlet chamber 120. The inlet chamber 119 forms a cylindrical space coaxial with the driving shaft 106 defined by a circumferential sidewall 104*e* formed by the boundary wall between the inlet chamber 119 and the outlet chamber 120, one end wall formed by the valve plate 103, and the other end wall 104*f* formed by the bottom wall of the cylinder head 104 opposing the valve plate 103.

A center gasket not shown in FIG. 1 is disposed between the front housing 102 and the cylinder block 101, a cylinder gasket and an inlet-valve-forming member not shown in FIG. 1 are disposed between the cylinder block 101 and the valve plate 103, and an outlet-valve-forming member 130 and a head gasket not shown in FIG. 1 are disposed between the valve plate 103 and the cylinder head 104. The front housing 102, the center gasket, the cylinder block 101, the cylinder gasket, the inlet-valve-forming member, the valve plate 103, the outlet-valve-forming member 130, the head gasket, and the cylinder head 104 are connected with each other by a plurality of through bolts 140 to form a compressor housing.

The cylinder block 101 is provided with a muffler 121. The muffler 121 is formed by an annular wall 101*b* formed on the outer surface of the cylinder block 101 and a cover 122 connected to the annular wall 101*b* with a seal member inserted between them. A check valve 200 is installed in a muffler space 123. The check valve 200 is located at the connection between the muffler space 123 and an outlet passage 124 formed in the cylinder head 104 and the cylinder block 101. The check valve 200 operates in proportion to the pressure difference between the internal pressure of the outlet passage 124 upstream of the check valve 200 and the internal pressure of the muffler space 123 downstream of the check valve 200. The check valve 200 closes the outlet passage 124 when the pressure difference is smaller than a predetermined level and opens the outlet passage 124 when the pressure difference is larger than the predetermined level. The outlet chamber 120 is connected to a high-pressure side external refrigerant circuit of an air conditioner through the outlet passage 124, the check valve 200, the muffler space 123 and an outlet port 122*a*.

The cylinder head 104 is provided with an inlet port 104*a* connecting with a low pressure side refrigerant circuit of the air conditioner and an inlet passage 104*b* extending from the inlet chamber 119, passing through the center portion of the end wall 104*f* of the cylinder head 104 to extend out of the inlet chamber 119, extending radially outward along the outside surface of the end wall 104*f*, and reaching the inlet port 104*a*.

An aperture control valve 300 is installed. The aperture control valve 300 is located at the connection between the inlet passage 104*b* and the inlet chamber 119. The aperture control valve 300 operates in proportion to the pressure difference between the internal pressure of the inlet passage 104*b* upstream of the aperture control valve 300 and the internal pressure of the inlet chamber 119 downstream of the aperture control valve 300. The aperture control valve 300 decreases the aperture of the inlet passage 104*b* to the minimum level when the pressure difference is smaller than a predetermined level, i.e., when the flow rate of refrigerant gas is very low, and increases the aperture of the inlet passage 104*b* when the flow rate of refrigerant gas increases and the pressure difference becomes larger than the predetermined level. The aperture control valve 300 decreases the aperture of the inlet passage 104*b* when the flow rate of refrigerant gas is very low to prevent pulsation of the internal pressure of the inlet chamber 119 from propagating to the air conditioner.

The cylinder head 104 is further provided with a displacement control valve 400. The displacement control valve 400 controls the aperture of a first communication passage 125 extending between the outlet chamber 120 and the crank chamber 105 to control the flow rate of the discharging refrigerant gas led into the crank chamber 105. The refrigerant gas in the crank chamber 105 is led into the inlet chamber 119 through a second communication passage formed by spaces between the bearings 115, 116 and the driving shaft 106, a space 101*c* between the end of the driving shaft 106 and the valve plate 103, and a fixed orifice 103*c* formed in the valve plate 103. The displacement control valve 400 can control the flow rate of the discharging refrigerant gas led into the crank chamber 105 to control the internal pressure of the crank chamber 105, thereby controlling the inclination angle of the swash plate 7, the stroke of the pistons 117, and the displacement of the variable displacement swash plate compressor 100. The displacement control valve 400 is an externally controlled displacement control valve operating in proportion to external control signals. The displacement control valve 400 detects the internal pressure of the inlet chamber 119 through a communication passage 126 to control the supply of electric current to a solenoid of the displacement control valve 400, thereby controlling the displacement of the compressor 100 to control the internal pressure of the inlet chamber 119 to a predetermined level. When the supply of electric current to the solenoid is stopped, the displacement control valve 400 forces a valve body thereof to open, thereby minimizing the displacement of the compressor 100.

Figure 2:
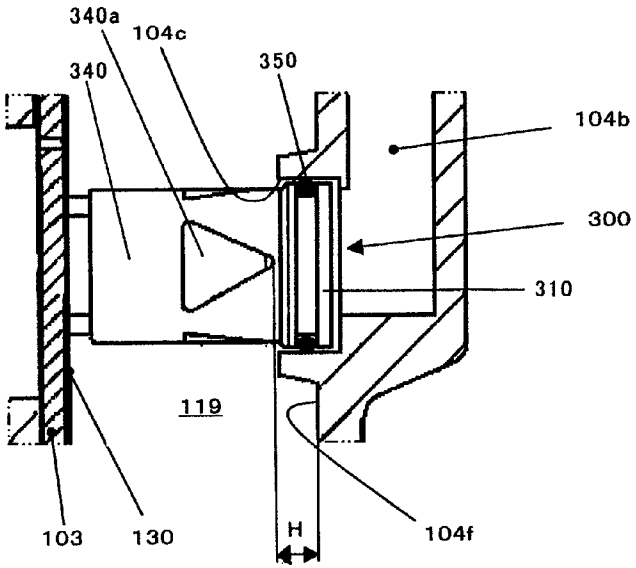
FIG. 2 is a partially enlarged view of FIG. 1.
Figure 3:
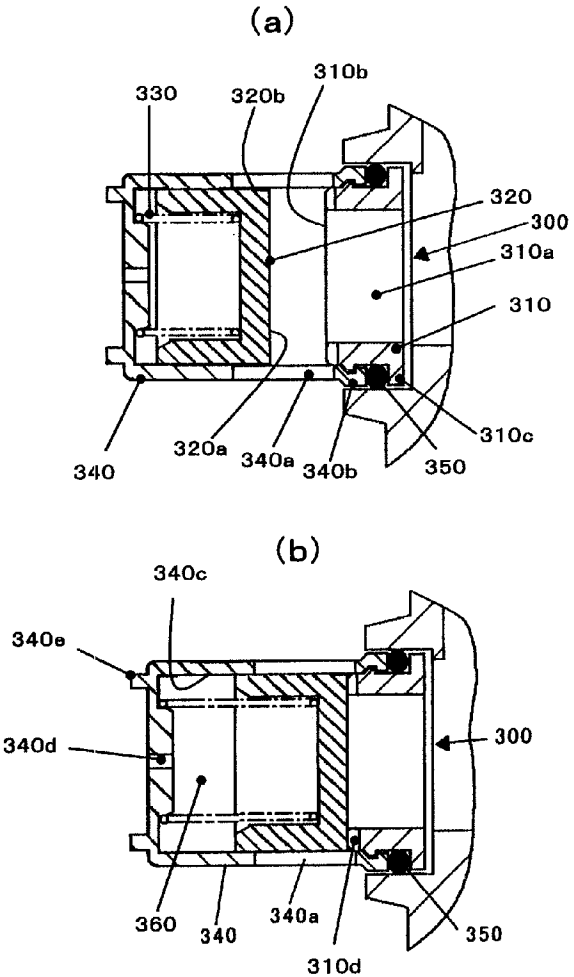
FIG. 3 is a set of sectional views of an inlet passage aperture control valve installed in the variable displacement swash plate compressor in accordance with the first preferred embodiment of the present invention. (a) shows the sectional view in open condition and (b) shows the sectional view in a condition, wherein a valve body sits on a valve seat.

As shown in FIGS. 2 and 3, the aperture control valve 300 comprises a first housing 310 made of resin and having a cylindrical form and provided with an inlet hole 310*a*, a valve seat 310*b* and a flange 310*c*, a valve body 320 made of resin and having a cylindrical form closed at one end and detachably abutting the valve seat 310*b*, a compression coil spring 330 for forcing the valve body 320 toward the valve seat 310*b*, and a second housing 340 made of resin and having a cylindrical form closed at one end and accommodating the valve body 320 and the compression coil spring 330. The second housing 340 is provided with plurality of outlet holes 340*a* in the circumferential sidewall. Each of the outlet holes 340*a* has a triangular form with one apex directed to the open end of the second housing. The second housing 340 is also provided with a flange 340*b* at the open end. A circumferential groove formed in the internal circumferential surface of the flange 340*b* resiliently engages a circumferential projection formed on the external circumferential surface of the valve seat side end portion of the first housing 310 to assemble the second housing 340 and the first housing 310 in a unit. An O-ring 350 is fitted on a circumferential groove formed by the flange 310*c* of the first housing 310, the flange 340*b* of the second housing 340 and the circumferential sidewall of the first housing 310.

The valve body 320 is provided with a flat surface 320*a* for abutting the valve seat, and an external circumferential side surface 320*b* for slidably abutting the internal circumferential side surface 340*c* of the second housing 340. The open area of the outlet holes 340*a* increases and decreases as the valve body 320 moves.

As shown in FIGS. 2 and 3, the aperture control valve 300 is installed in the inlet chamber 119 with one end provided with the inlet hole 310*a* being fitted in a circular concave 104*c* formed around the part of the end wall 104*f* of the inlet chamber where the inlet passage 104*b* passes through, the other end formed by the end wall of the second housing 340 being directed to the outlet-valve-forming member 130 disposed adjacent to the valve plate 103, and projects from the end wall 104*f* of the inlet chamber toward the outlet-valve-forming member 130. The O-ring 350 is pressed against the circumferential sidewall of the circular concave 104*c* so that the aperture control valve 300 is held by the circular concave 104*c* and eventually by the cylinder head 104. The outlet holes 340*a* of the aperture control valve 300 oppose the circumferential sidewall 104*e* of the inlet chamber 119.

As shown in FIG. 3, the valve seat 310*b* of the first housing 310 is provided with plurality of radial grooves 310*d*. Each of the grooves 310*d* communicates with the apex portion of one of the outlet holes 340*a*. Therefore, the inlet passage 104*b* is not completely closed when the flat surface 320*a* of the valve body 320 sits on the valve seat 310*b* but communicates with the inlet chamber 119 through the inlet hole 310*a*, the grooves 310*d* and the apex portions of the outlet holes 340*a*. The open area of the apex portion of the outlet hole 340*a* is smaller than that of the groove 310*d* when the flat surface 320*a* of the valve body 320 site on the valve seat 310*b*. Therefore, the area of the apex portions of the outlet holes 340*a* is the minimum open area of the outlet holes 340*a*. The aforementioned minimum open area is designed as the minimum area capable of preventing self-exited vibration of the valve body 320 when the flow rate of the refrigerant gas is very low.

The inlet chamber 119 can form a large space of great diameter because the inlet chamber 119 is given a cylindrical form and disposed radially inside the annular outlet chamber 120. The aperture control valve 300 can be engaged with the wide end wall 104*f* of the inlet chamber 119 before the cylinder head 104 is assembled with the valve plate 103 and the cylinder block 101. Thus, installation of the aperture control valve 300 becomes easy.

The aperture control valve 300 is connected to the large-area end wall 104*f* of the inlet chamber 119. Therefore, sufficient distance can be established between the outlet holes 340*a* of the aperture control valve 300 and the circumferential sidewall 104*e* of the inlet chamber 119 opposing the outlet holes 340*a* so as to secure sufficient sectional area of the inlet passage near the outlet holes 340*a* of the aperture control valve 300.

As shown in FIG. 2, the outlet holes 340*a* are located so as to project the apexes thereof into the inlet chamber 119 by a distance H from the end wall 104*f* of the inlet chamber 119. As aforementioned, the inlet chamber 119 can form a large space of great diameter so as to operate as a muffler. When an air passage is connected to a muffler, it is possible to control the length of the portion of the air passage projecting into the muffler so as to control the noise frequency to be decreased. In the compressor 100, the distance H between the apexes of the outlet holes 340*a* and the end wall 104*f* of the inlet chamber 119 corresponds to the aforementioned length of the portion of the air passage projecting into the muffler. Therefore, it is possible to control the distance H and make the noise frequency to be decreased resonant with the frequency of inlet pressure pulsation, thereby optimizing the structure of the aperture control valve 300 from the viewpoint of decreasing inlet pressure pulsation.

The aperture control valve 300 fits in a circular concave 104*c* formed in the end wall 104*f* of the inlet chamber 119 at the one end provided with the inlet hole 310*a*. Thus, the installation of the aperture control valve 300 in the compressor 100 becomes easy. The other end of the aperture control valve 300 is directed to the outlet-valve-forming member 130. Therefore, even if the aperture control valve 300 is forced in the direction of slipping off from the circular concave 104*c*, the aperture control valve 300 abuts the outlet-valve-forming member 130 at the other end and the O-ring 350 does not escape from the circular concave 104*c*. Thus, the outlet-valve-forming member 130 prevents the slipping off of the aperture control valve 300.

The central axis of the circular concave 104*c* and eventually the central axis of the aperture control valve 300 extend parallel to the central axes of the cylinder bores 101*a* and are located inside a circle inscribed in the cylinder bores 101*a* so as to be substantially aligned with the central axis of the driving shaft 106. Therefore, the aperture control valve 300 is located substantially at the center of the inlet chamber 119 of cylindrical form and substantially at equal distance from the cylinder bores 101*a*. Therefore, variance among the flow rates of the refrigerant gas sucked into the cylinder bores 101*a* during inlet stroke decreases, compressing operations in the cylinder bores 101*a* are made appropriate, and good performance of the compressor 100 is achieved.

As shown in FIGS. 2 and 3, a small hole 340*d* is formed in the end wall of the second housing 340. The small hole 340*d* communicates a space 360 defined by the second housing 340 and the valve body 320 with the inlet chamber 119.

The bottom wall of the second housing 340 is provided with downward projections 340*e*. Therefore, even if the aperture control valve 300 abuts the outlet-valve-forming member 130, a space is formed between the bottom wall of the second housing 340 and the outlet-valve-forming member 130 by the projections 340*e*, communication between the inlet chamber 119 and the small hole 340*d* and eventually the space 360 is maintained, and internal pressure of the inlet chamber 119 is reliably applied on the rear surface of the valve body 320. Therefore, the valve body 320 operates reliably in proportion to the pressure difference between the internal pressure of the inlet passage 104*b* upstream of the valve body 320 and the internal pressure of the inlet chamber 119 downstream of the valve body 320. The operation characteristics of the valve body 320 are determined by the pressure receiving area of the valve body 320 and the biasing force of the compression coil spring 330.

Preferred Embodiment 2

Figure 4:
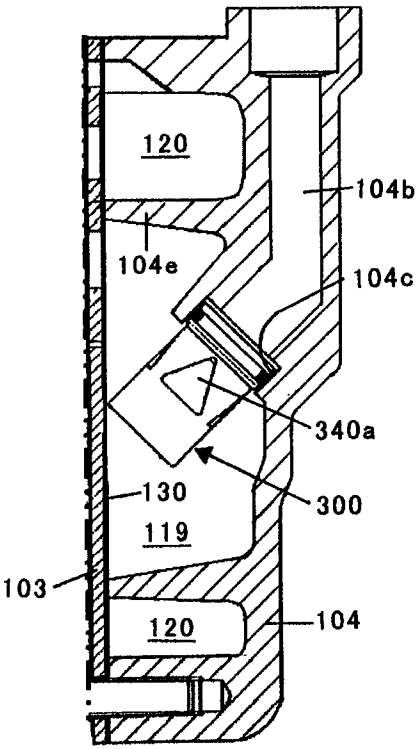
FIG. 4 is a fragmentary sectional view of a variable displacement swash plate compressor in accordance with a second preferred embodiment of the present invention.

In the first preferred embodiment, the central axis of the aperture control valve 300 is substantially aligned with the central axis of the driving shaft 106. As shown in FIG. 4, the central axis of the aperture control valve 300 can be inclined relative to the central axis of the driving shaft 106. Even if the height of the inlet chamber 119 is restricted, it is possible to install the aperture control valve 300 in the inlet chamber 119 by inclining the central axis of the aperture control valve 300 relative to the central axis of the driving shaft 106.

The circular concave 104*c* is inclined. The aperture control valve 300 is fitted in the inclined circular concave 104*c* at the one end provided with the inlet hole 310*a* and slantedly opposes the outlet-valve-forming member 130 disposed adjacent to the valve plate 103 at the other end. Some of the outlet holes 340*a* slantedly oppose the end wall 104*f* of the inlet chamber 119 or the outlet-valve-forming member 130, and some of the remaining outlet holes 340*a* oppose the circumferential sidewall 104*e* of the inlet chamber 119. Every one of the outlet holes 340*a* is sufficiently distanced from the opposite wall. Therefore, sufficient sectional area of the inlet passage is secured near the outlet holes 340*a* of the aperture control valve 300.

Because of the inclined installation of the aperture control valve 300, a space is established between the bottom wall of the second housing 340 and the outlet-valve-forming member 130 even if the bottom wall of the second housing 340 is not provided with such projections as the projections 340*e* formed on the bottom wall of the second housing 340 in the first embodiment. Thus, the inlet chamber 119 reliably communicates with the small hole 340*d* and eventually the space 360.

Preferred Embodiment 3

Figure 5:
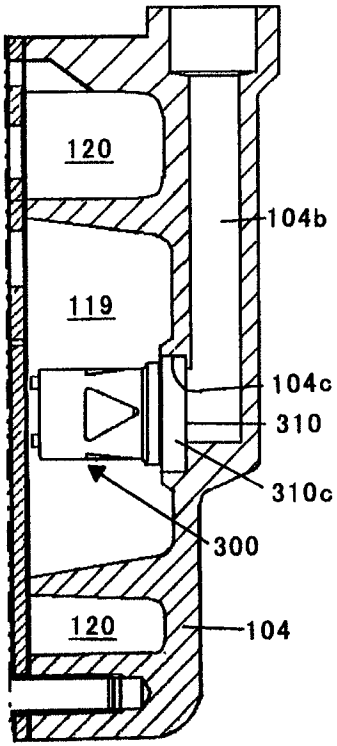
FIG. 5 is a fragmentary sectional view of a variable displacement swash plate compressor in accordance with a third preferred embodiment of the present invention.

In the first preferred embodiment, the aperture control valve 300 is held by the circular concave 104*c* and eventually the cylinder head 104 by means of the O-ring 350 fitted on the outer circumferential surface of the one end of the aperture control valve 300. As shown in FIG. 5, the first housing 310 can be made of metal and press fitted in the circular concave 104*c* at the flange 310*c*. The press fitting enables reliable retention of the aperture control valve 300 by the circular concave 104*c* and also omission of the O-ring 350.

Preferred Embodiment 4

Figure 6:
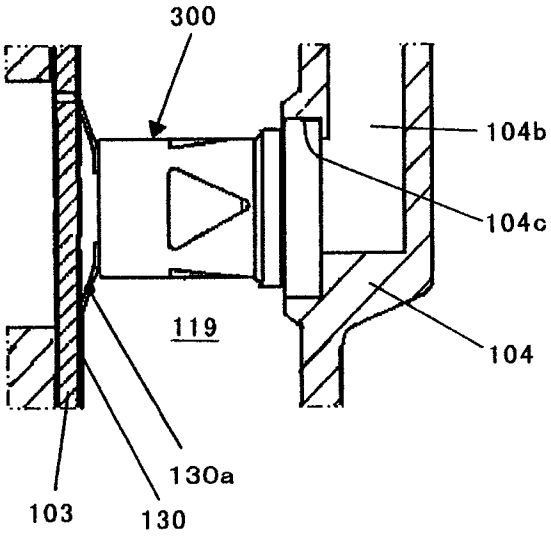
FIG. 6 is a fragmentary sectional view of a variable displacement swash plate compressor in accordance with a fourth preferred embodiment of the present invention.

In the third preferred embodiment, the aperture control valve 300 is held by the cylinder head 104 by means of press fitting. As shown in FIG. 6, it is possible to fit the one end of the aperture control valve 300 in the circular concave 104*c* with a micro-space present between them and force the other end of the aperture control valve 300 toward the one end by resilient members 130*a*, thereby holding the aperture control valve 300 by the cylinder head 104. Each of the resilient members 130*a* can be made, for example, by one part of the outlet-valve-forming member 130 with sufficient resilience cut out from the remaining part and raised up to form a spring.

Aforementioned structure enables omission of the press fitting operation and makes the installation of the aperture control valve 300 in the circular concave 104*c* easy. Each of the resilient members 130*a* is made from a part of the existing member 130. Therefore, the number of elements does not increase.

Preferred Embodiment 5

Figure 7:
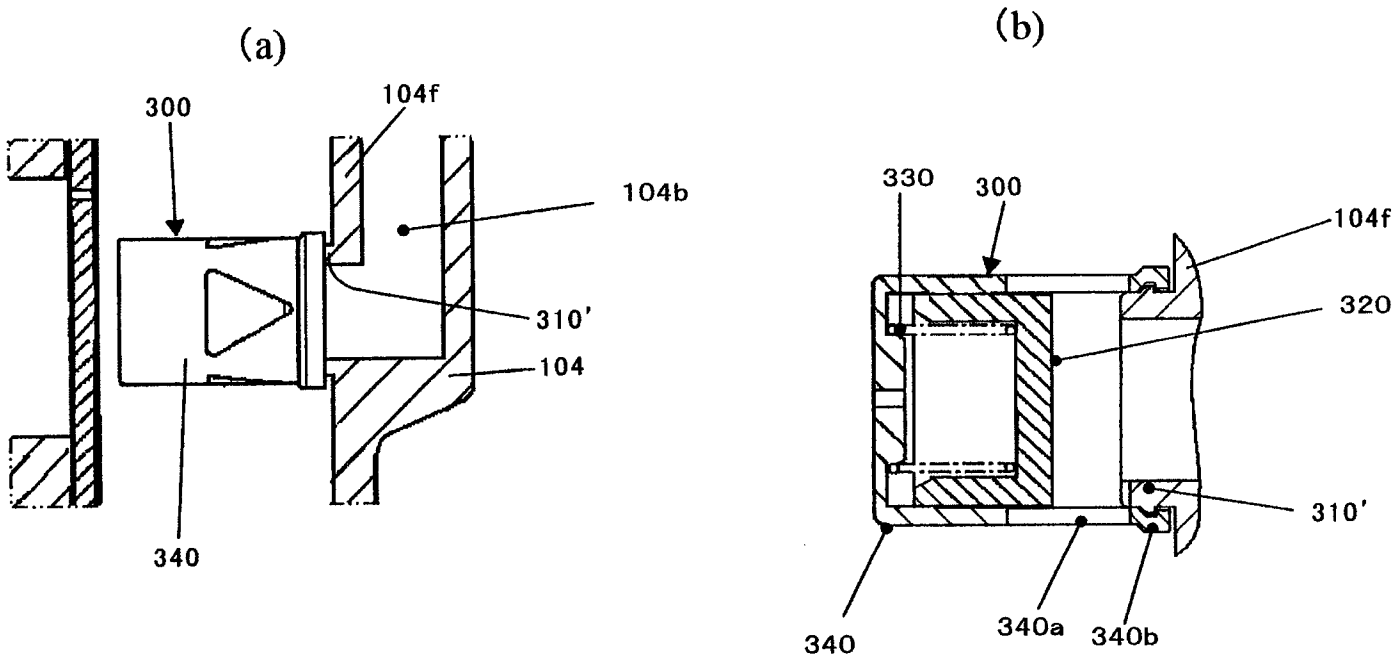
FIG. 7 is a set of fragmentary sectional views of a variable displacement swash plate compressor in accordance with a fifth preferred embodiment of the present invention. (a) shows an exterior view of the inlet passage aperture control valve and (b) shows a sectional view of the inlet passage aperture control valve.

As shown in FIG. 7, a first housing 310' of the aperture control valve 300 can be formed integrally with the end wall 104*f* of the inlet chamber 119.

A circumferential groove formed in the flange 340*b* of the second housing 340 is resiliently fitted on a circumferential projection formed on one end of the first housing 310' so as to fix the second housing 340 to the first housing 310' and eventually the cylinder head 104. The number of elements decreases by forming the first housing 310' integrally with the cylinder head 104.

In the preferred embodiments 1 to 5, the outlet-valve-forming member 130 operates as the anti-slip-off member. The valve plate 103 or the head gasket disposed between the outlet-valve-forming member 130 and the cylinder head 104 can operate as the anti-slip-off member.

It is possible to make holes large enough for accommodating the aperture control valve 300 in the head gasket, the outlet-valve-forming member 130 and the valve plate 103, thereby making the inlet-valve-forming member provided with the inlet valves or the cylinder gasket disposed between the inlet-valve-forming member and the cylinder block 101 operate as the anti-slip-off member. In accordance with the aforementioned structure, an extra space equal to the sum of the thicknesses of the head gasket, the outlet-valve-forming member 130 and the valve plate 103 is formed in the axial direction. Thus, the installation space of the aperture control valve 300 increases.

Preferred Embodiment 6

Figure 8:
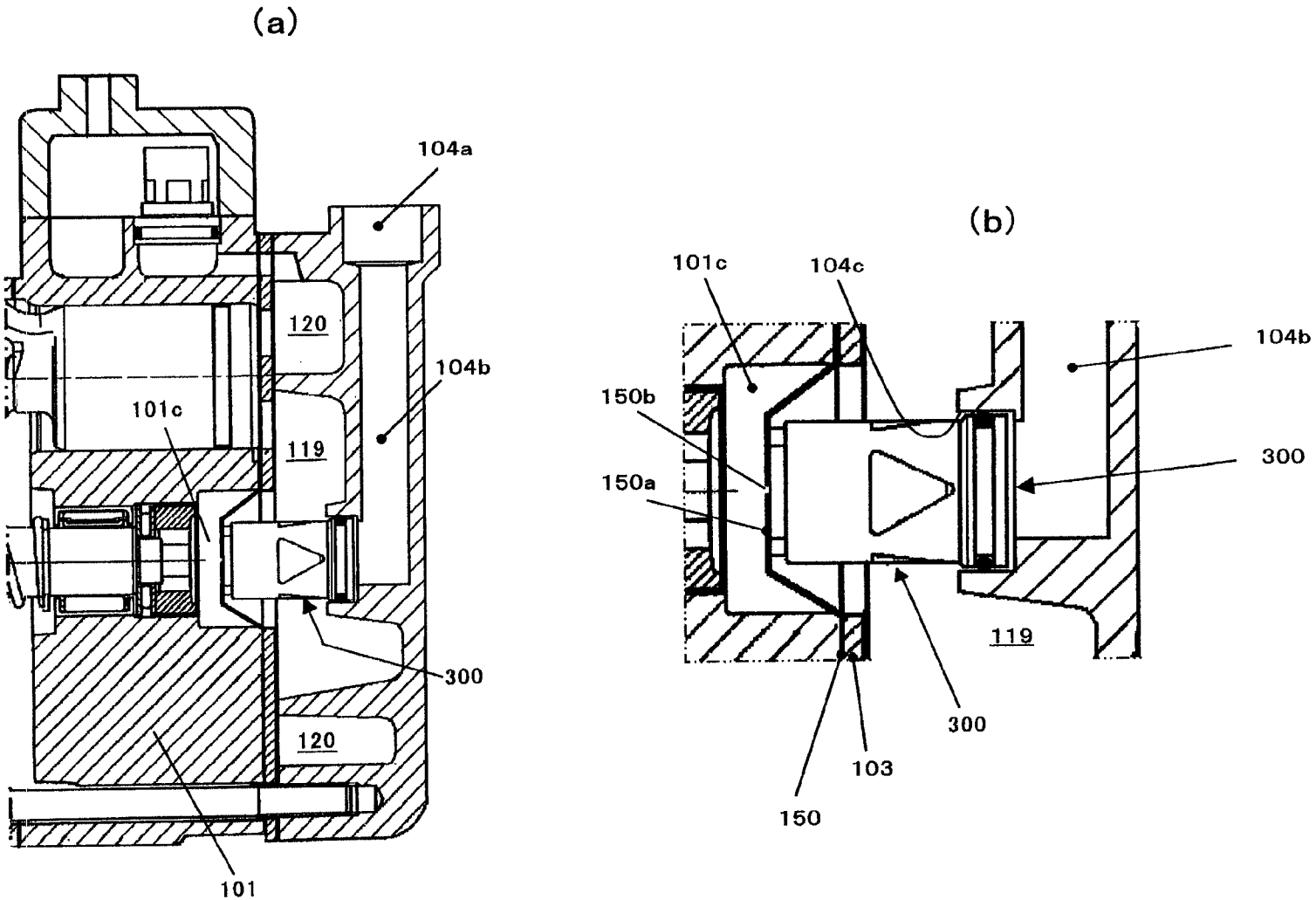
FIG. 8 is a set of fragmentary sectional views of a variable displacement swash plate compressor in accordance with a sixth preferred embodiment of the present invention. (a) shows an exterior view of the inlet passage aperture control valve and (b) shows a partially enlarged view of (a).

As shown in FIG. 8, it is possible to make holes large enough for accommodating the aperture control valve 300 in the head gasket, the outlet-valve-forming member 130, the valve plate 103 and the inlet-valve-forming member and make a part of the cylinder gasket 150 project into a concave formed in the center of the cylinder block 101 (a space 101*c* formed between the end of the driving shaft 106 and the valve plate 103) so as to form a projection 150*a* with the form of a circular truncated cone, thereby making the projection 150*a* operate as the anti-slip-off member. In this case, the cylinder gasket 150 forms a part of the partition wall defining the inlet chamber 119. An orifice 150*b* is made in the projection 150*a*. The cylinder gasket 150 is made of thin metal plate coated by rubber material. The projection 150*a* with a form of circular truncated cone is press molded.

When the other end of the aperture control valve 300 enters into the concave 101*c* of the cylinder block 101, the aperture control valve 300 can be installed in the inlet chamber 119 without difficulty even if the cylinder head 104 cannot be made sufficiently high. When the inlet port 104*a* is disposed in the circumferential side portion of the cylinder head 104, the aperture control valve 300 can be installed without difficulty even if the inlet port 104*a* is located near the valve plate 103. In FIG. 8, a part of the cylinder gasket 150 operates as the anti-slip-off member. A part of any one of the head gasket, the outlet-valve-forming member 130 or the inlet-valve-forming member can operate as the anti-slip-off member.

In FIG. 6, a part of the outlet-valve-forming member 130 is cut out and raised up to form a spring, thereby forming a biasing member for forcing the other end of the aperture control valve 300 toward the one end. A spring independent of the outlet-valve-forming member 130 can be disposed so as to force the aperture control valve.

In the preferred embodiments 1, 3 and 6, the bottom wall of the second housing 340 is provided with projections 340*e* for reliably communicating the space 360 with the inlet chamber 119. The anti-slip-off members such as the outlet-valve-forming member 130, etc. can be provided with projections.

In the aforementioned preferred embodiments, the minimum opening of the aperture control valve is established by the outlet holes 340*a*. It is possible to completely close the outlet holes 340*a* when the valve body 320 sits on the valve seat and make a communication hole formed in another member, for example the valve body 320, operate as the minimum opening of the aperture control valve.

In the aforementioned preferred embodiments, the aperture control valve is provided with the minimum opening for preventing the inlet passage from shutting off when the valve body sits on the valve seat. The aperture control valve can be such that the inlet passage is completely closed when the valve body sits on the valve seat.

The present invention can be applied to variable displacement swash plate compressors, fixed displacement swash plate compressors, wobble plate compressors, and any other type of reciprocating compressors.

INDUSTRIAL APPLICABILITY

The present invention can be widely applied to reciprocating compressors provided with aperture control valves for inlet passages.

BRIEF DESCRIPTION OF THE REFERENCE NUMERALS

100 Variable displacement swash plate compressor
101 Cylinder block
102 Front housing
103 Valve plate
104 Cylinder head
104*b* Inlet passage
104*e* Circumferential sidewall
104*f* End wall
119 Inlet chamber
120 Outlet chamber
130 Outlet-valve-forming member
300 Aperture control valve

The invention claimed is:

1. A reciprocating compressor comprising:

a cylinder block provided with a plurality of cylinder bores, a valve plate opposing one end of the cylinder block at one end face and provided with at least one inlet hole and outlet hole pair each opposing one of the cylinder bores, and a cylinder head opposing an other end face of the valve plate and forming at the other end face side of the valve plate an annular outlet chamber and a cylindrical inlet chamber disposed radially inside the outlet chamber, wherein the cylinder head is provided with:

an inlet passage extending from the inlet chamber to connect with an external refrigerating circuit;

an outlet passage extending from the outlet chamber to connect with the external refrigerating circuit; and an aperture control valve disposed in the inlet chamber and provided with an inlet hole connecting with the inlet passage and outlet holes communicating with the inlet chamber and controlling the aperture of the inlet passage in proportion to a pressure difference between an internal pressure of the inlet passage and the internal pressure of the inlet chamber, wherein the aperture control valve engages an end wall of the inlet chamber opposing the valve plate at one end provided with the inlet hole and projects from the end wall of the inlet chamber toward an other end and the valve plate, and wherein the aperture control valve fits in a recess formed in the end wall of the inlet chamber at one end provided with the inlet hole and abuts an anti-slip-off member at the other end to be prevented from axial movement.

2. The reciprocating compressor of claim 1, wherein the outlet holes of the aperture control valve oppose the circumferential sidewall of the inlet chamber.

3. The reciprocating compressor of claim 1, wherein the outlet holes of the aperture control valve are formed in a circumferential sidewall of a cylindrical body engaging the end wall of the inlet chamber at one end and projecting toward the other end and the valve plate, and wherein the outlet holes are located at a predetermined distance from the end wall of the inlet chamber at the portions of the peripheries close to the one end of the cylindrical body engaging the end wall of the inlet chamber.

4. The reciprocating compressor of claim 1, wherein the anti-slip-off member is selected from the group consisting of the valve plate, an outlet-valve-forming member provided with outlet valves, a head gasket disposed between the outlet-valve-forming member and the cylinder head, an inlet-valve-forming member provided with inlet valves, and a cylinder gasket disposed between the inlet-valve-forming member and the cylinder block.

5. The reciprocating compressor of claim 1, wherein the anti-slip-off member and also a partition wall defining the inlet chamber is selected from the group consisting of an outlet-valve-forming member provided with outlet valves, a head gasket disposed between the outlet-valve-forming member and the cylinder head, an inlet-valve-forming member provided with inlet valves, and a cylinder gasket disposed between the inlet-valve-forming member and the cylinder block, and wherein a recess is formed in the one end of the cylinder block and the anti-slip-off member projects into the recess of the cylinder block.

6. The reciprocating compressor of claim 1, wherein the anti-slip-off member forms a biasing member for forcing the other end of the aperture control valve toward the one end.

7. The reciprocating compressor of claim 6, wherein the biasing member is a resilient member formed by one part of the outlet-valve-forming member cut out and raised up from the remaining part.

8. The reciprocating compressor of claim 1, wherein the aperture control valve comprises a first housing of cylindrical form provided with the inlet hole and a valve seat, a valve body detachably abuts the valve seat to open and close the inlet hole, a biasing member for forcing the valve body toward the valve seat, and a second housing of cylindrical form closed at one end provided with a plurality of outlet holes in the circumferential sidewall and a small hole in the bottom wall and accommodating the valve body and the biasing member and fitting on and fixed to the first housing, wherein a space formed by the bottom wall of the second housing, the valve body, and the circumferential sidewall of the second housing communicates with the inlet chamber through the small hole formed in the bottom wall of the second housing when the other end of the aperture control valve abuts the anti-slip-off member.

9. The reciprocating compressor of claim 8, further comprising projections provided on the bottom wall of the second housing or the anti-slip-off member, wherein the projections form a space between the small hole formed in the bottom wall of the second housing and the anti-slip-off member when the other end of the aperture control valve abuts the anti-slip-off member.

10. The reciprocating compressor of claim 1, further comprising an O-ring fitting on an outer circumferential surface of the one end of the aperture control valve, wherein the O-ring is forced to abut the circumferential wall of the concave formed in the end wall of the inlet chamber to make the cylinder head hold the aperture control valve.

11. The reciprocating compressor of claim 1, wherein the aperture control valve comprises a first housing provided with the inlet hole and a valve seat, a valve body detachably abuts the valve seat to open and close the inlet hole, a biasing member for forcing the valve body toward the valve seat, and a second housing of cylindrical form closed at one end provided with a plurality of outlet holes in a circumferential sidewall and a small hole in a bottom wall and accommodating the valve body and the biasing member and fitting on and fixed to the first housing, wherein the end wall of the inlet chamber opposing the valve plate forms the first housing.

12. The reciprocating compressor of claim 1, wherein the central axis of the aperture control valve extends parallel to the central axes of the cylinder bores and is located inside a circle inscribed in the cylinder bores.

* * * * *